US005999775A

United States Patent [19]

Kim

[11] Patent Number: 5,999,775

[45] Date of Patent: Dec. 7, 1999

[54] DRIVING DEVICE FOR HEATING ROLLER OF IMAGE FORMING APPARATUS IN WHICH HEATING ROLLER IS MOVED TO CONTACT OR SEPARATE FROM A PHOTOSENSITIVE BELT BY A SINGLE MOTOR

[75] Inventor: Nam-ryoung Kim, Suwon, Rep. of Korea

[73] Assignee: Samsung Electronics Co., Ltd., Kyungki-Do, Rep. of Korea

[21] Appl. No.: 09/113,030

[22] Filed: Jul. 13, 1998

[30] Foreign Application Priority Data

Aug. 19, 1997 [KR] Rep. of Korea ..... 97-22419

[51] Int. Cl.[6] ..... G03G 15/00; G03G 15/11

[52] U.S. Cl. ..... 399/167; 399/251

[58] Field of Search ..... 399/324–327, 399/357, 123, 351, 167, 126, 251, 119, 121

[56] References Cited

U.S. PATENT DOCUMENTS 5,689,764 11/1997 Fukuchi et al. ..... 399/167 X
5,852,761 12/1998 Marcelletti et al. ..... 399/325 X

FOREIGN PATENT DOCUMENTS 59-34575 2/1984 Japan .
7-306620 11/1995 Japan .

*Primary Examiner*—Arthur Grimley
*Assistant Examiner*—Quana Grainger
*Attorney, Agent, or Firm*—Sughrue, Mion, Zinn, Macpeak & Seas, PLLC

[57] ABSTRACT

A heating roller driving device for a heating roller of an image forming apparatus. The heating roller driving device includes a motor for supplying the heating roller with a driving force for the heating roller to contact or separate from a photosensitive belt. A motor controller is provided for controlling the operation of the motor, and a main controller is included for providing the motor controller with a predetermined command to operate the motor. A lever is pivotably installed on the shaft of the heating roller for moving the heating roller to contact or separate from the photosensitive belt, a roller gear is installed at one end of the shaft of the heating roller for receiving the driving force transferred from the motor, a clutch is installed at a predetermined location in the vicinity of the heating roller for pushing the lever or for releasing the lever from the pushed state to in turn move the heating roller to contact or separate from the photosensitive belt by the driving force transferred from the motor, and a plurality of motor gears is installed on the output shaft of the motor for selectively transferring the driving force of the motor to either the roller gear or the clutch depending on a position of the clutch and in turn the heating roller. Since the heating roller is moved to contact or separate from the photosensitive belt by a single motor, the driving device has advantages in that the entire system structure can be simplified and the manufacturing cost of the apparatus can be lowered.

10 Claims, 4 Drawing Sheets

DRIVING DEVICE FOR HEATING ROLLER OF IMAGE FORMING APPARATUS IN WHICH HEATING ROLLER IS MOVED TO CONTACT OR SEPARATE FROM A PHOTOSENSITIVE BELT BY A SINGLE MOTOR

BACKGROUND OF THE INVENTION

1. Field of the Invention

The present invention relates to a driving device for a heating roller of an image forming apparatus and, more particularly, to a driving device for a heating roller of an image forming apparatus in which the heating roller is moved to contact or separate from a photosensitive belt by a single motor.

2. Description of the Related Art

In general, an image forming apparatus which reproduces images of text and/or pictures on a recording medium according to transmitted image data signals is provided with a photosensitive member such as a photosensitive drum or a photosensitive belt for forming an electrostatic latent image thereon, a charging device for charging the surface of the photosensitive member, an exposure device for forming an electrostatic latent image of a predetermined pattern by illuminating the charged surface of the photosensitive member with a light beam, a developing device for developing the electrostatic latent image by applying a developing agent such as developer liquid or a toner to the exposed latent electrostatic image, and a transfer device for transferring the developed image to a recording medium.

FIG. 1 shows a schematic diagram illustrating the structure of a conventional image forming apparatus.

Referring to FIG. 1, the image forming apparatus comprises a photosensitive belt 104 to circulate around first, second and third belt rollers 101, 102 and 103, a discharging device 105 for removing any charge remaining on the photosensitive belt 104, and a charging device 106 for charging the surface of the photosensitive belt 104. Exposure devices 107, 108, 109 and 110 having respective laser scanning units (not shown) are provided for illuminating an imaging region of the charged photosensitive belt 104 to selectively remove charge in the shape of an image by respective laser beams in order to form an electrostatic latent image. Developing devices 111, 112, 113 and 114 are provided for developing the electrostatic latent image by applying a developer liquid. A drying device 115 is provided for drying the developer liquid applied to the latent image, and a transfer device 116 is provided for transferring an image developed on the photosensitive belt 104 to a recording medium 117 such as a paper sheet or a film frame.

In this case, the developing device 111 comprises a developing roller 111*a* for applying the developer liquid to the photosensitive belt 104, a developer liquid supplying device 111*b* for supplying the developer liquid to the developing roller 111*a*, a cleaning roller 111*c* for removing the developer liquid adhering to the rear surface portion of the developing roller 111*a*, first and second squeegee rollers 111*d* and 111*e* for removing excess developer liquid from the photosensitive belt 104, first and second blades 111*f* and 111*g* for removing the developer liquid adhering to the first and second squeegee rollers 111*d* and 111*e*, and a developer liquid recovery container 111*h* for recovering the developer liquid within the apparatus. In addition, the drying device 115 is provided with a heating roller 115*h* for drying the developer liquid adhering to the photosensitive belt 104, and the transfer device 116 comprises a transfer roller 116*t* for transferring an image from the photosensitive belt 104 to a recording paper by relatively rotating in contact with the first belt roller 101 with the photosensitive belt 104 interposed therebetween, and a pressure roller 116*p* for fixing the image transferred on the transfer roller 116*t* onto the recording paper by relatively rotating in contact with the transfer roller 116*t* with the recording paper interposed therebetween.

On the other hand, in the conventional image forming apparatus constructed as described above, the drying device 115 is provided with auxiliary rollers 115*r* and 115*s* in addition to the heating roller 115*h*, as shown in FIG. 2. The auxiliary rollers 115*r* and 115*s* remove the liquid toner remaining on the heating roller 115*h*, and also a voltage higher than a development voltage of the photosensitive belt 104 is applied to the heating roller 115*h* via the auxiliary rollers 115*r* and 115*s* to prevent the liquid toner on the photosensitive belt 104 from adhering to the surface of the heating roller 115*h*.

In the drying device 115 as described above, while the image forming apparatus is in an operating state, the heating roller 115*h* is caused to contact the photosensitive belt 104 in order to remove the remaining liquid toner on the photosensitive belt 104, and while the image forming apparatus is not in the operating state, the heating roller 115*h* is caused to separate from the photosensitive belt 104. Conventionally, the contacting and separating movements of the heating roller 115*h* are performed by two respective driving motors 203 and 204. Therefore, the structure of the apparatus is complicated, and the manufacturing cost of the apparatus is high because two motors 203 and 204 are used. In FIG. 2, reference numeral 201 denotes a main controller which commands the operations of the two motors 203 and 204, and reference numeral 202 denotes a motor controller which controls the operation of the motors 203 and 204 corresponding to the command from the main controller 201.

SUMMARY OF THE INVENTION

To solve the above problems, it is an object of the present invention to provide a driving device for a heating roller of an image forming apparatus in which the heating roller contacts or separates from a photosensitive belt by a driving force of a single motor.

Accordingly, to achieve the above object, there is provided a heating roller driving device for driving a heating roller of an image forming apparatus which includes a photosensitive belt, the heating roller having a shaft, comprising a motor for supplying the heating roller with a driving force for the heating roller to contact or separate from the photosensitive belt, the motor including an output shaft, a motor controller for controlling the operation of the motor, a main controller for providing the motor controller with a predetermined command to operate the motor, a lever pivotably installed on the shaft of the heating roller for moving the heating roller to contact or separate from the photosensitive belt, a roller gear installed at one end of the shaft of the heating roller for receiving the driving force transferred from the motor, a clutch, installed at a predetermined position in the vicinity of the heating roller, for pushing the lever or for releasing the lever from the pushed state to in turn move the heating roller to contact or separate from the photosensitive belt by the driving force transferred from the motor, and a plurality of motor gears installed on the output shaft of the motor for selectively transferring the driving force of the motor to either the roller gear or the clutch depending on a position of the clutch and in turn the heating roller.

Since the heating roller is moved to contact or separate from the photosensitive belt by a single motor, differing from the conventional driving device, the present invention as described above has the advantages in that the entire system structure can be simplified and the manufacturing cost of the apparatus can be lowered.

BRIEF DESCRIPTION OF THE DRAWINGS

The above object and advantages of the present invention will become more apparent by describing in detail a preferred embodiment thereof with reference to the accompanying drawings, in which.

DETAILED DESCRIPTION OF THE PREFERRED EMBODIMENTS

Figure 1:
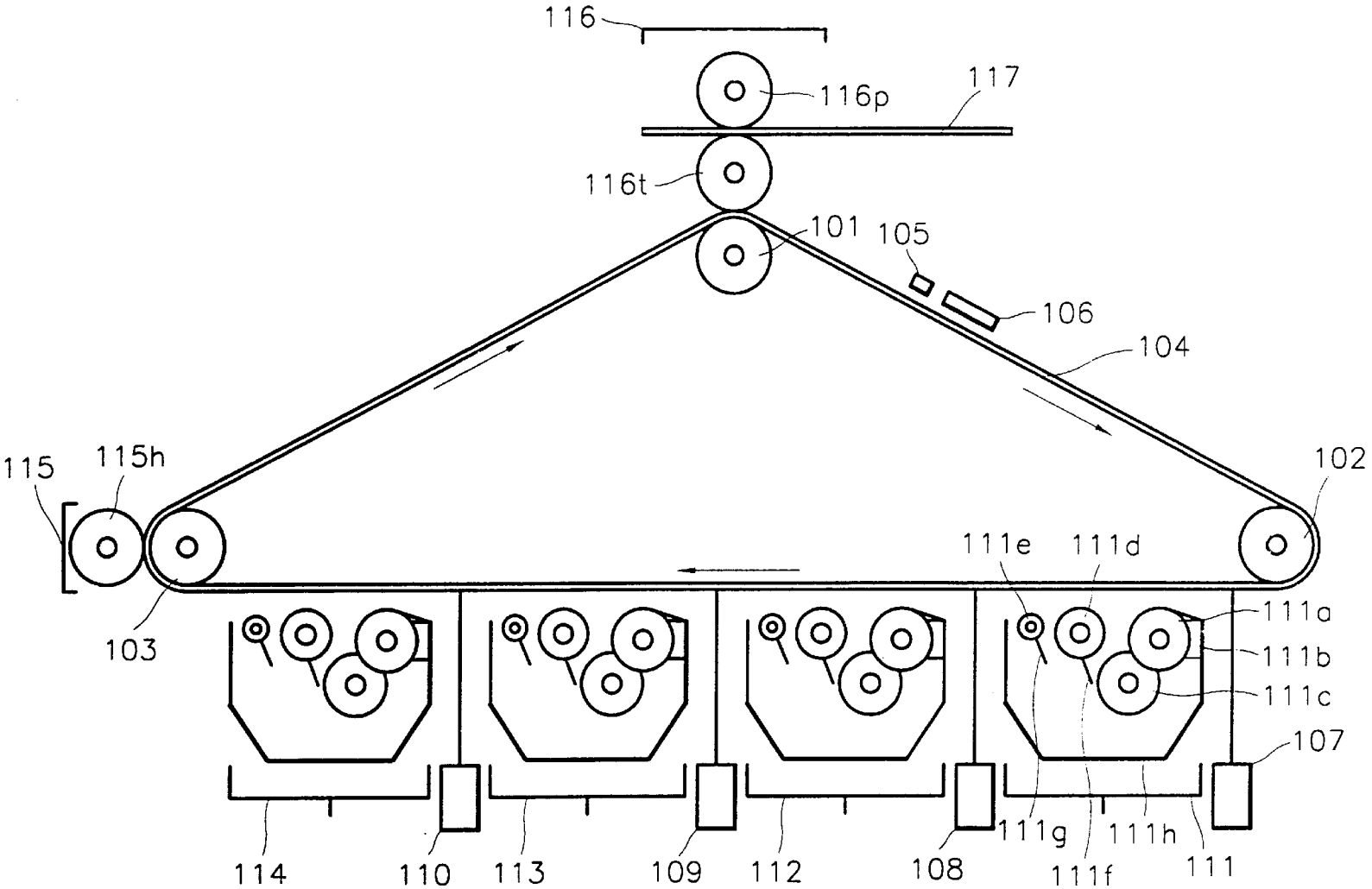
FIG. 1 PRIOR ART
FIG. 1 is a schematic diagram illustrating the structure of a conventional image forming apparatus.
Figure 2:
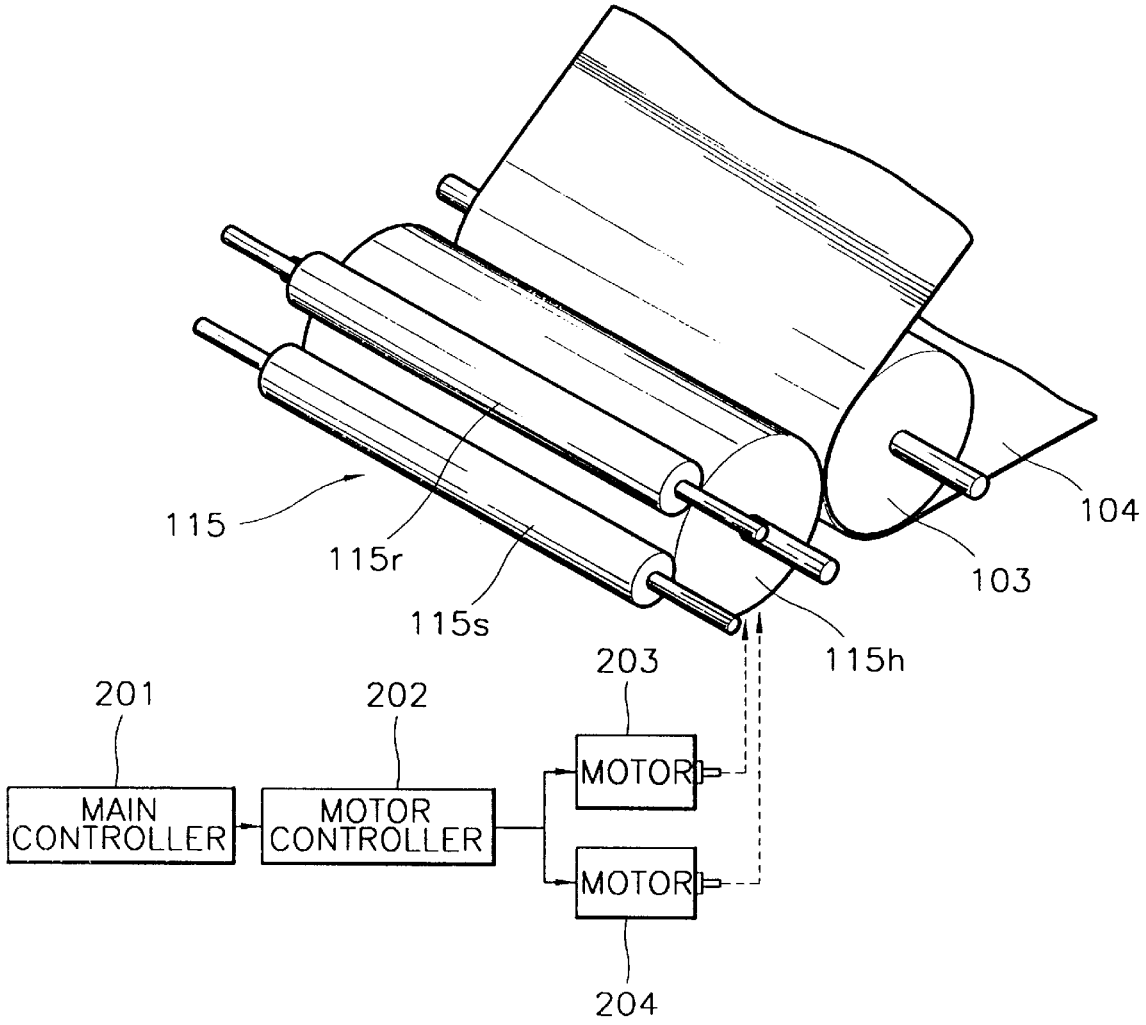
FIG.2(PRIOR ART)
FIG. 2 is a perspective view and a diagram schematically illustrating the structure of a driving device of a heating roller of a conventional image forming apparatus.
Figure 3:
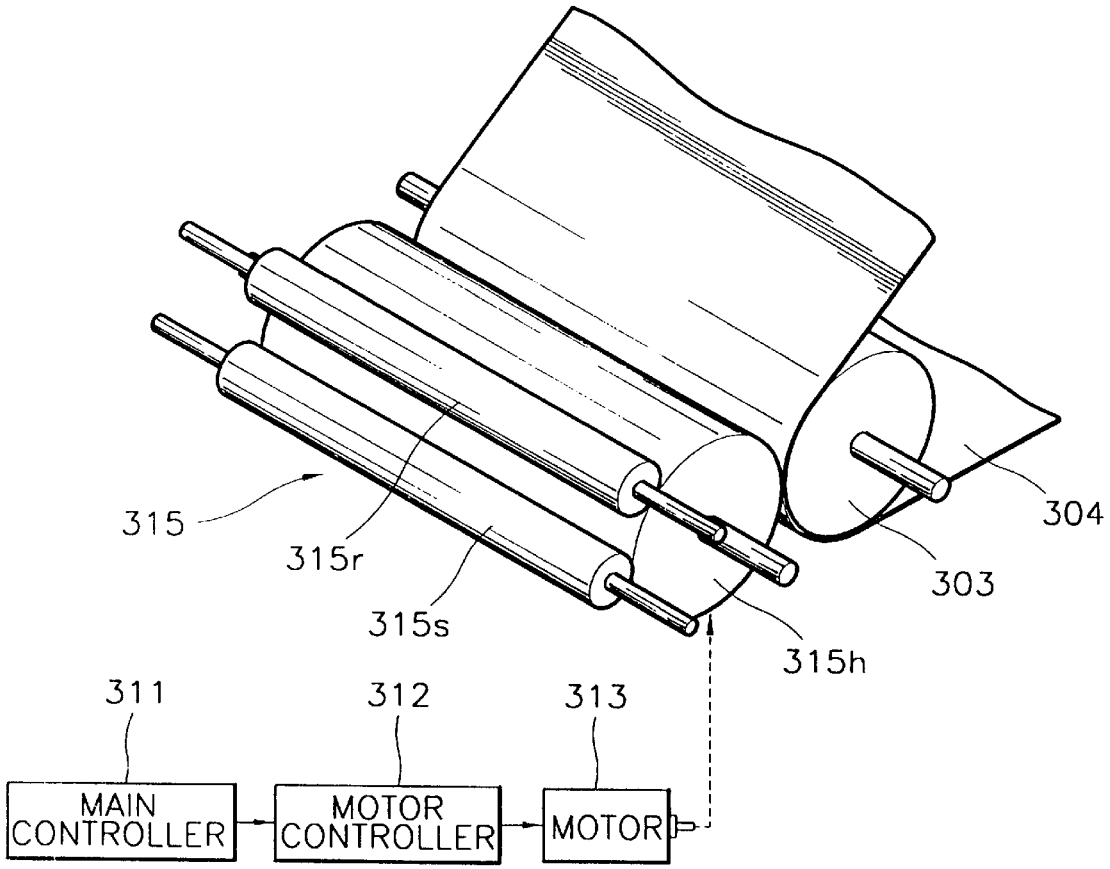
FIG. 3 is a perspective view and a diagram schematically illustrating the structure of a driving device of a heating roller of an image forming apparatus according to the present invention.
Figure 4:
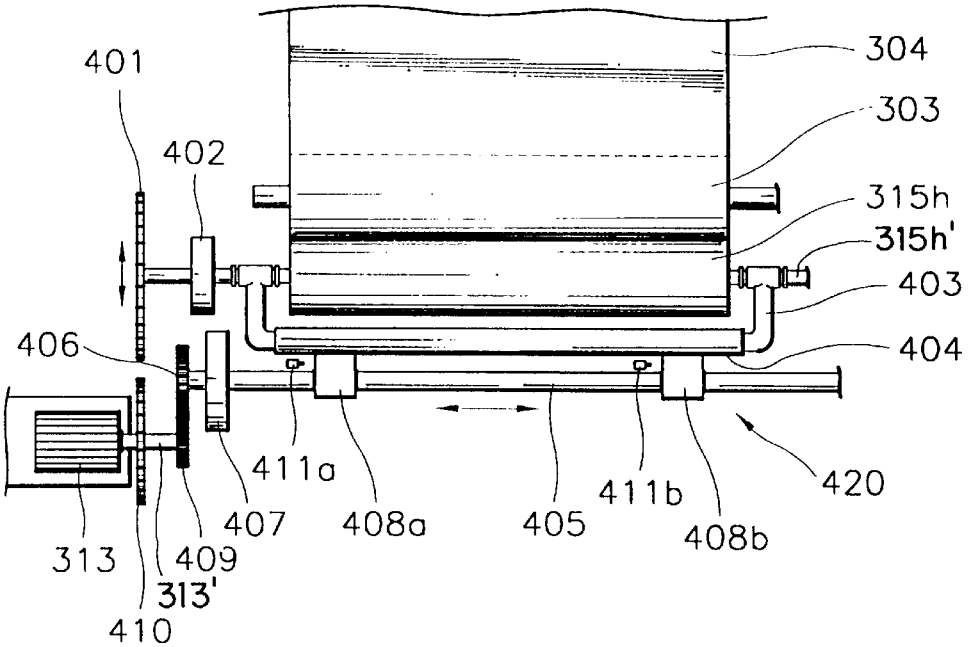
FIG. 4 is a plan view illustrating a state in which a heating roller contacts a photosensitive belt by an operation of a heating roller driving device of an image forming apparatus according to the present invention.
Figure 5:
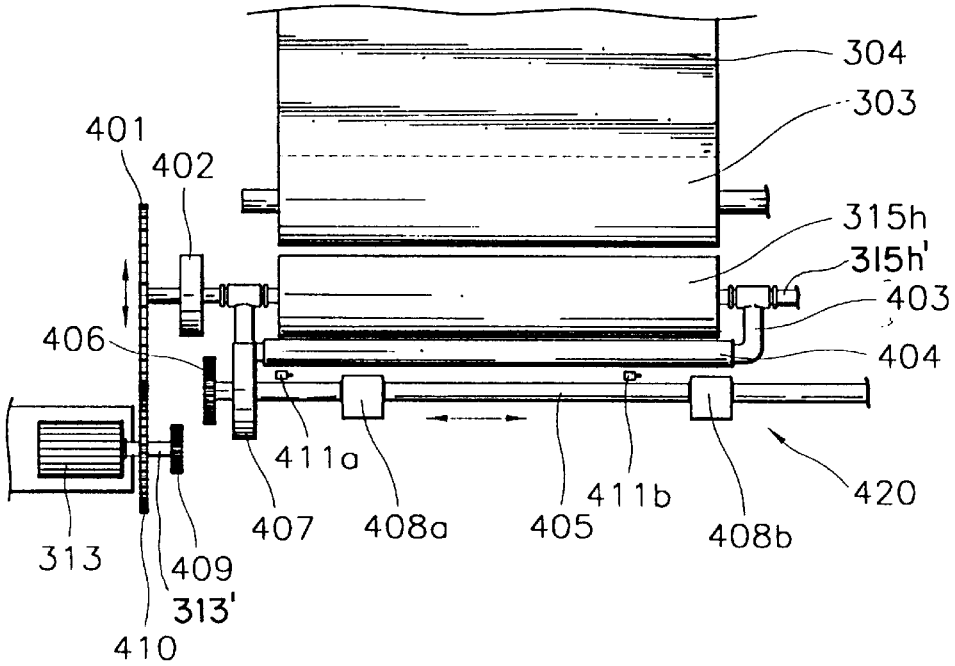
FIG. 5 is a plan view illustrating another state in which a heating roller is separated from a photosensitive belt by an operation of a heating roller driving device of an image forming apparatus according to the present invention.

Referring to FIGS. 3 through 5, a driving device for a heating roller of an image forming apparatus according to the present invention is shown and comprises a motor 313 for providing a heating roller 315*h* with a driving force for the heating roller 315*h* to contact or separate from a photosensitive belt 304, a motor controller 312 for controlling the operation of the motor 313, and a main controller 311 for providing the motor controller 312 with a predetermined command to operate the motor 313.

In this case, a lever 403 is pivotably installed on the shaft 315*h*' of the heating roller 315*h* for moving the heating roller 315*h* to contact or separate from a photosensitive belt 304. Thus, the shaft 315*h*' of the heating roller 315*h* is permitted to rotate and move toward and away from the belt 304. This can be accomplished, for example, by providing a housing portion (not shown) having a suitable slot formed therein for receiving an end of the shaft 315*h*'. A roller gear 401 which has a predetermined pitch circle is installed at one end of the shaft of the heating roller 315*h* for receiving the driving force transferred from the motor 313. A tubular member 404 is rotatably installed around the lever 403 to reduce the contact friction between the lever 403 and cams 408*a* and 408*b*.

In addition, a clutch 420 is installed at a predetermined position in the vicinity of the heating roller 315*h* to be movable in a direction parallel to the shaft of the heating roller 315*h* for moving the heating roller 315*h* to contact or separate from the photosensitive belt 304 by the driving force transferred from the motor 313. Two motor gears 409 and 410 are installed on the output shaft 313' of the motor 313 for transferring a driving force of the motor 313 to the roller gear 401 and clutch 420. In particular, a flywheel 402 is installed on the shaft of the heating roller 315*h* for smoothly rotating the heating roller 315*h* and for stabilizing the engagement of the roller gear 401 to the motor gear 410.

The clutch 420 comprises a clutch shaft 405 installed to be parallel to the shaft of the heating roller 315*h*, a clutch gear 406 installed at one end of the clutch shaft 405 for receiving power from the motor gear 409, and the two cams 408*a* and 408*b* for pushing the lever 403 or for releasing the lever 403 from such a pushing status while rotating according to the rotation of the clutch shaft 405. In particular, a flywheel 407 is installed on the clutch shaft 405 for smoothly rotating the clutch shaft 405 and for stabilizing the engagement of the clutch gear 406 to the motor gear 409. In addition, sensors 411*a* and 411*b* are installed at predetermined places in the vicinity of the cams 408*a* and 408*b* for detecting the rotation of the cams 408*a* and 408*b*. At this time, the sensors 411*a* and 411*b* are electrically connected to the main controller 311.

The motor gears 409 and 410 comprise a first motor gear 409 which engages with the clutch gear 406 and transfers a driving force of the motor 313 to the cams 408*a* and 408*b* for the heating roller 315*h* to contact the photosensitive belt 304, and a second motor gear 410 which engages with the roller gear 401 and transfers a driving force of the motor 313 to the heating roller 315*h* when the heating roller 315*h* is separated from the photosensitive belt 304. In this case, it is preferable that the first motor gear 409 has a smaller pitch circle than the second motor gear 410. In FIG. 3, reference numeral 303 denotes a third belt roller, reference numeral 315 denotes a drying device, and reference numerals 315*r* and 315*s* denote auxiliary rollers.

The operation of the above heating roller driving device of an image forming apparatus according to the present invention is described below with reference to FIGS. 3, 4 and 5.

When an image forming apparatus operates and the photosensitive belt 304 is circulated, the clutch 420 moves in a direction parallel to the shaft thereof, i.e., left in FIG. 4, and the clutch gear 406 engages with the first motor gear 409, as shown in FIG. 4. In the above state, when the motor 313 operates and the clutch shaft 405 rotates, the cams 408*a* and 408*b* installed at the clutch shaft 405 rotate to raise the lever 403 installed at the shaft of the heating roller 315*h*. At this time, after the lever 403 rotates a predetermined amount, the lever cannot rotate any further due to a stopper (not shown). However, the cams 408*a* and 408*b* continue to rotate until reaching a predetermined position. That is, when the sensors 411*a* and 411*b* detect that the cams 408*a* and 408*b* have reached the predetermined position, the sensors 411*a* and 411*b* send a signal to the main controller 311, and the main controller 311 gives a command to the motor controller 312 to stop the motor 313 corresponding to the detected signal of the sensors 411*a* and 411*b*. Then, the motor controller 312 cuts off electric power to the motor 313, the motor 313 stops, and at the same time the cams 408*a* and 408*b* stop rotating.

Meanwhile, the cams 408*a* and 408*b* are in pressing contact with the tubular member 404 of the lever 403. Accordingly, the shaft of the heating roller 315*h* is subject to a pressing force, and the heating roller 315 is pushed. As a result, the heating roller 315*h* contacts the circulating photosensitive belt 304, and the heating roller 315*h* is relatively rotated by a frictional force with the photosensitive belt 304. In addition, while the heating roller 315*h* is rotated and evaporates the developer liquid adhering to the photosensitive belt 304, the remaining liquid toner is removed by the auxiliary rollers 315*r* and 315*s* relatively rotating in contact with the heating roller 315*h*. At this time, the heating roller 315*h*, of course, continues to contact the photosensitive belt 304 by the cams 408*a* and 408*b* and lever 403.

On the other hand, when the photosensitive belt 304 stops circulating, the motor 313 operates again based on a command sent from the main controller 311. Accordingly, the cams 408*a* and 408*b* rotate again, and the lever 403 returns to its original position, as shown in FIG. 5. That is, the lever 403 moves from a raised position to a lowered original position. When the lever 403 returns to its original position, the clutch 420 moves right and the clutch gear 406 disengages from the first motor gear 409. Then, the heating roller 315*h*, which is in a pressed state, returns to its original position, and the roller gear 401 engages with the second motor gear 410. In the above state, the motor 313 operates and the transferred driving force of the motor 313 rotates the heating roller 315*h*. Also, the remaining liquid toner is removed by the auxiliary rollers 315*r* and 315*s* rotating in contact with the heating roller 315*h*.

The back and forth movement of the clutch 420 is caused by a force transferring mechanism (not shown) combined with the driving device of the belt roller 303. That is, while the driving device of the belt roller 303 operates, the clutch 420 is moved toward the left in FIGS. 4 and 5 by the force transferring mechanism, and when the driving device for the belt roller 303 stops, the clutch 420 is moved back toward the right in FIGS. 4 and 5 by the force transferring mechanism.

As described above, in the heating roller driving device of an image forming apparatus according to the present invention, since the heating roller contacts or separates from a photosensitive belt by a driving force of a single motor, the present invention has advantages in that the entire system structure can be simplified and the manufacturing cost of an apparatus can be lowered.

It is contemplated that numerous modifications may be made to the driving device for heating roller of an image forming apparatus of the present invention without departing from the spirit and scope of the invention as defined in the following claims.

What is claimed is:

1. A heating roller driving device for a heating roller of an image forming apparatus which includes a photosensitive belt, the heating roller having a shaft, comprising:

a single motor for supplying the heating roller with a driving force for the heating roller to contact or separate from the photosensitive belt, said motor including an output shaft;

a motor controller for controlling the operation of said motor, a main controller for providing said motor controller with a predetermined command to operate said motor;

a lever pivotally installed on the shaft of the heating roller for moving the heating roller to contact or separate from the photosensitive belt;

a roller gear installed at one end of the shaft of the heating roller for receiving the driving force transferred from said motor;

a clutch, installed at a predetermined position in a vicinity of the heating roller, for pushing said lever or for releasing said lever from the pushed state to in turn move the heating roller to contact or separate from the photosensitive belt by the driving force transferred from said motor; and a plurality of motor gears installed on the output shaft of said motor for selectively transferring the driving force of said motor to either said roller gear or said clutch depending on a position of said clutch and in turn the heating roller.

2. The heating roller driving device as claimed in claim 1, further comprising a flywheel installed on the shaft of the heating roller for smoothly rotating the heating roller and for stabilizing the engagement of said roller gear to a corresponding one of said motor gears.

3. The heating roller driving device as claimed in claim 1, wherein said clutch comprises a rotatable clutch shaft installed parallel to the shaft of the heating roller, a clutch gear installed at one end of said clutch shaft for receiving power from a corresponding one of said motor gears, and a plurality of cams for pushing said lever or for releasing said lever from the pushed state while rotating according to the rotation of said clutch shaft.

4. The heating roller driving device as claimed in claim 3, further comprising a flywheel installed on said clutch shaft for smoothly rotating said clutch shaft and for stabilizing the engagement of said clutch gear to said corresponding motor gear.

5. The heating roller driving device as claimed in claim 3, further comprising sensors respectively installed at predetermined locations in a vicinity of said cams for detecting the rotation of said cams.

6. The heating roller driving device as claimed in claim 3, wherein said lever includes a tubular member rotatably installed around said lever for reducing contact friction between said lever and said plurality of cams.

7. The heating roller driving device as claimed in claim 1, wherein said plurality of motor gears comprises a first motor gear which engages with said clutch gear and transfers a driving force of said motor to said cams for the heating roller to contact the photosensitive belt, and a second motor gear which engages with said roller gear and transfers the driving force of said motor to the heating roller when the heating roller is separated from the photosensitive belt.

8. The heating roller driving device as claimed in claim 7, wherein said first motor gear has a pitch circle which is smaller than a pitch circle of said second motor gear.

9. A heating roller driving device for a heating roller of an image forming apparatus which includes a photosensitive belt, the heating roller having a shaft, comprising:

a motor for supplying the heating roller with a driving force for the heating roller to contact or separate from the photosensitive belt, said motor including an output shaft;

a motor controller for controlling the operation of said motor, a main controller for providing said motor controller with a predetermined command to operate said motor;

a lever pivotally installed on the shaft of the heating roller for moving the heating roller to contact or separate from the photosensitive belt;

a roller gear installed at one end of the shaft of the heating roller for receiving the driving force transferred from said motor;

a clutch, installed at a predetermined position in a vicinity of the heating roller, for pushing said lever or for releasing said lever from the pushed state to in turn move the heating roller to contact or separate from the photosensitive belt by the driving force transferred from said motor; and a plurality of motor gears installed on the output shaft of said motor for selectively transferring the driving force of said motor to either said roller gear or said clutch depending on a position of said clutch and in turn the heating roller, wherein said plurality of motor gears comprises a first motor gear which engages with said clutch gear and transfers a driving force of said motor to said cams for the heating roller to contact the photosensitive belt, and a second motor gear which engages with said roller gear and transfers the driving force of said motor to the heating roller when the heating roller is separated from the photosensitive belt.

10. The heating roller driving device as claimed in claim 9, wherein said first motor gear has a pitch circle which is smaller than a pitch circle of said second motor gear.

* * * * *